United States Patent [19]

Barreto

[11] Patent Number: 5,018,968

[45] Date of Patent: May 28, 1991

[54] REVOLVING GRATE COOLER FOR COOLING OF CLINKER OR SIMILAR PRODUCTS

[76] Inventor: Jose D. Barreto, Rua Barao de Granito, 95 Casa Amarela, Recife - PE, Brazil

[21] Appl. No.: 354,470

[22] Filed: May 19, 1989

[30] Foreign Application Priority Data

Jun. 15, 1988 [BR] Brazil ..... PI8802994

[51] Int. Cl.[5] ..... F27B 7/38

[52] U.S. Cl. ..... 432/116; 110/226; 432/78; 432/80; 432/117; 432/118

[58] Field of Search ..... 432/78, 80, 116, 117, 432/118; 110/226, 246

[56] References Cited

U.S. PATENT DOCUMENTS 1,491,894 4/1924 Atkinson ..... 110/226
1,697,268 1/1929 Evesmith ..... 110/226 X
3,847,095 11/1974 Bauer et al. ..... 110/246
3,940,241 2/1976 Houd ..... 432/78 X
4,793,269 12/1988 Dezubay et al. ..... 110/226 X

FOREIGN PATENT DOCUMENTS

A655014 7/1951 United Kingdom .
A905659 9/1962 United Kingdom .

*Primary Examiner*—Edward G. Favors
*Attorney, Agent, or Firm*—Darby & Darby

[57] ABSTRACT

A revolving grate cooler for cooling of clinker or similar products comprising a tubular shaped body having a plurality of holes. A plurality of curved metal cooling plates having a plurality of openings are secured to a front inner surface of the body, and a plurality of curved plates having smooth surfaces, some of which have outwardly extending projections, are secured to a middle portion of the body. A pressurized chamber communicates with the body to provide air flow through the holes and openings for cooling the products within the body.

17 Claims, 5 Drawing Sheets

REVOLVING GRATE COOLER FOR COOLING OF CLINKER OR SIMILAR PRODUCTS

This invention refers to a simple, sturdy and efficient revolving cooler, for continuous and quick cooling of clinker or similar products, which proceed from baking ovens where they are produced at quite high temperatures, due to conditions inherent to the process of fabrication.

The name "clinker" is given to the cement in its raw state, constituted by macroscopical particles of a rather heterogeneous granulometry and colouring which may vary from light to dark gray, thus conferring to same a particular aspect, not to be confounded, up to the moment when it is ground together with other aggregates, being transformed in powder, with an adequate thickness for its utilization.

In the hereto attached drawings, which are an integrant part of this Description, FIG. 1 represents the longitudinal section of the cooler, subject of the now dealt with invention, showing the different parts which compose it, whilst the following FIGS. 2, 3, 4 and 5 represent, respectively, its left side view and the sections AB, CD, EF, which were indicated on the FIG. 1 itself, in order to show other inside complemementary details of the invention, so as FIG. 6 is an isometric view of part of the revolving cooler shown in FIG. 1;

Figure 1:
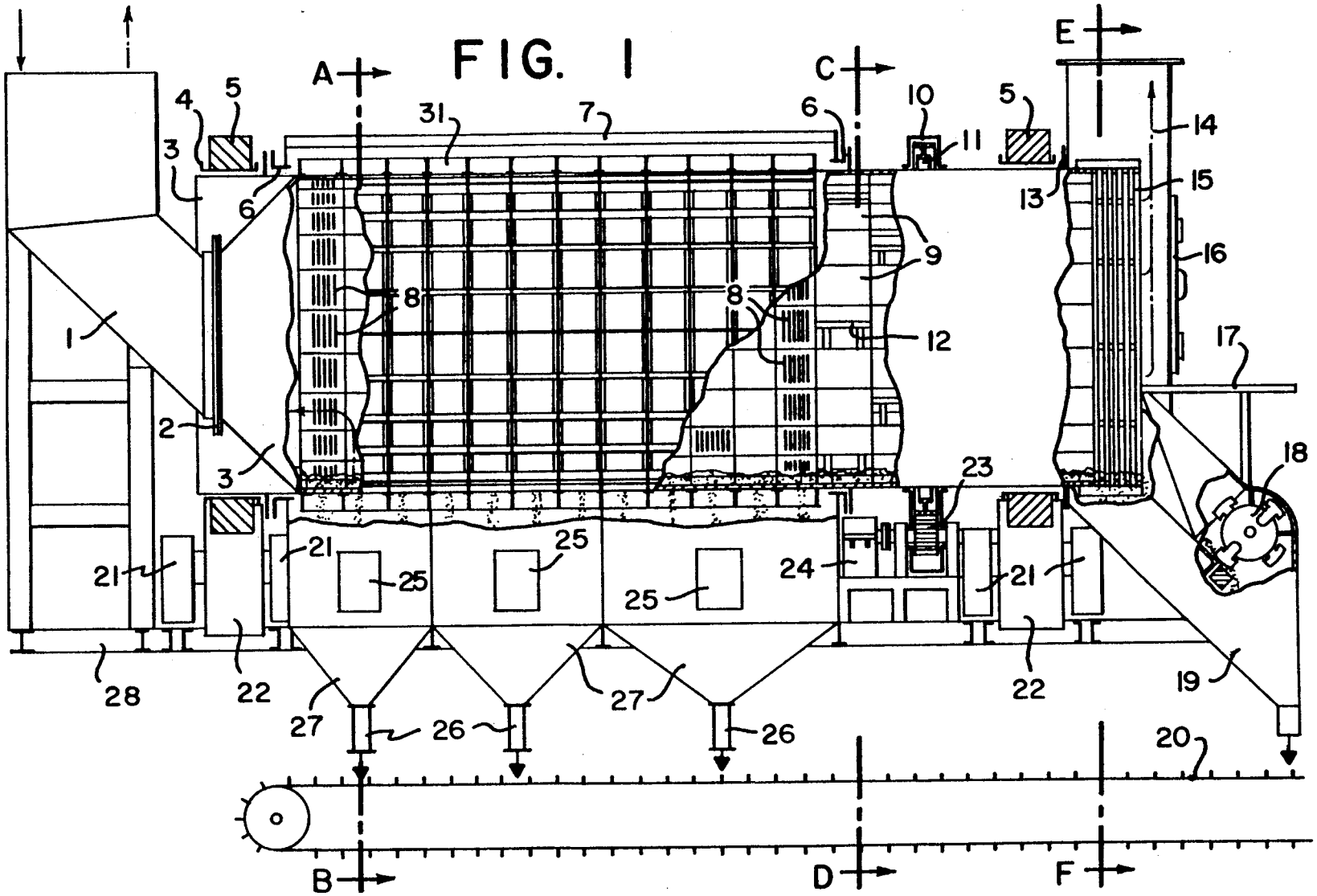
Figure 2:
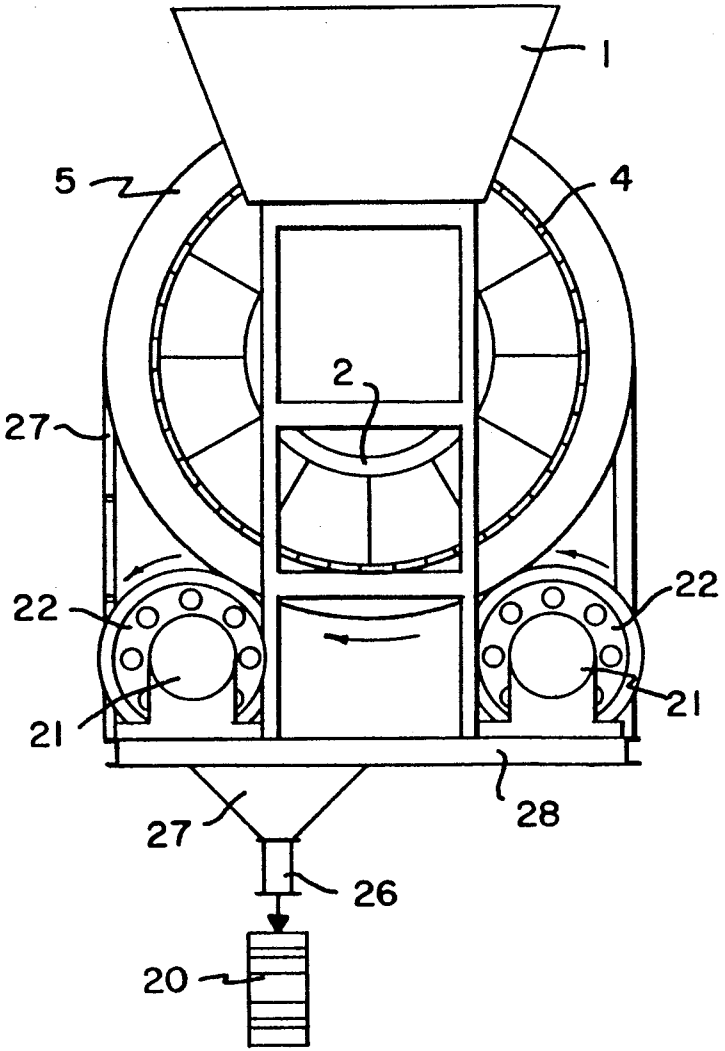

With the help of the already mentioned figures, where all component parts of the cooler are conveniently numbered, we can easily follow their functional description, which are:

"FEEDING DUCT (1)"—Produced in welded carbon steel plate and internally coated with refractory bricks, its ultimate object is to transport, by gravity, the hot clinker, introduced into its upper part down to the cooling plates (8), as well as to convey the hot air (secondary air) from the inside of the revolving grate up to the combustion zone of the baking oven (see FIGS. 1 and 2)

"INTERNAL SEALING SYSTEM (2)"—Produced in carbon steel plate and cast iron plates, operates as mechanical seal by means of springs or air piston action, to avoid the entry of false cold air from the environment into the inside of the revolving grate, which is kept in constant depression, due to the action of the baking oven exhauster (see FIGS. 1 and 2).

"REVOLVING GRATE (3)"—Produced in welded carbon steel plate, it is the largest and most important part of this cooler, its ultimate object being to cause the turbulent revolving movement of the clinker or similar product on the cooling plates (8), which are fixed on its inner surface, furthering its cooling.

"BEARING SHOES (4)"—Produced in carbon steel plate and fastened to the outside surface of the revolving grate (3) by means of weld or screws, its ultimate object being to reinforce and improve its support on the inner surfaces of rolling rings (5) and also to keep them fixed in relation to any axial displacements (see FIGS. 1 and 2).

"ROLLING RINGS (5)"—Produced in cast steel and fully machined, its function being to support the revolving grate (3) by means of bearing shoes (4), as well as to permit the free revolving movement of the entire unit on the supporting rollers (22) (see FIGS. 1 and 2).

"OUTSIDE SEALING SYSTEMS (6)"—Produced in carbon steel plate and cast iron plates, they serve as a mechanical seal due to spring or air piston action, to avoid the entry of the outsie false air up to the inside of the revolving grate, kept in constant depression, as well as to avoid the output of the cold air from the pressurized chambers (27) up to the environment (see FIG. 1).

Figure 3:
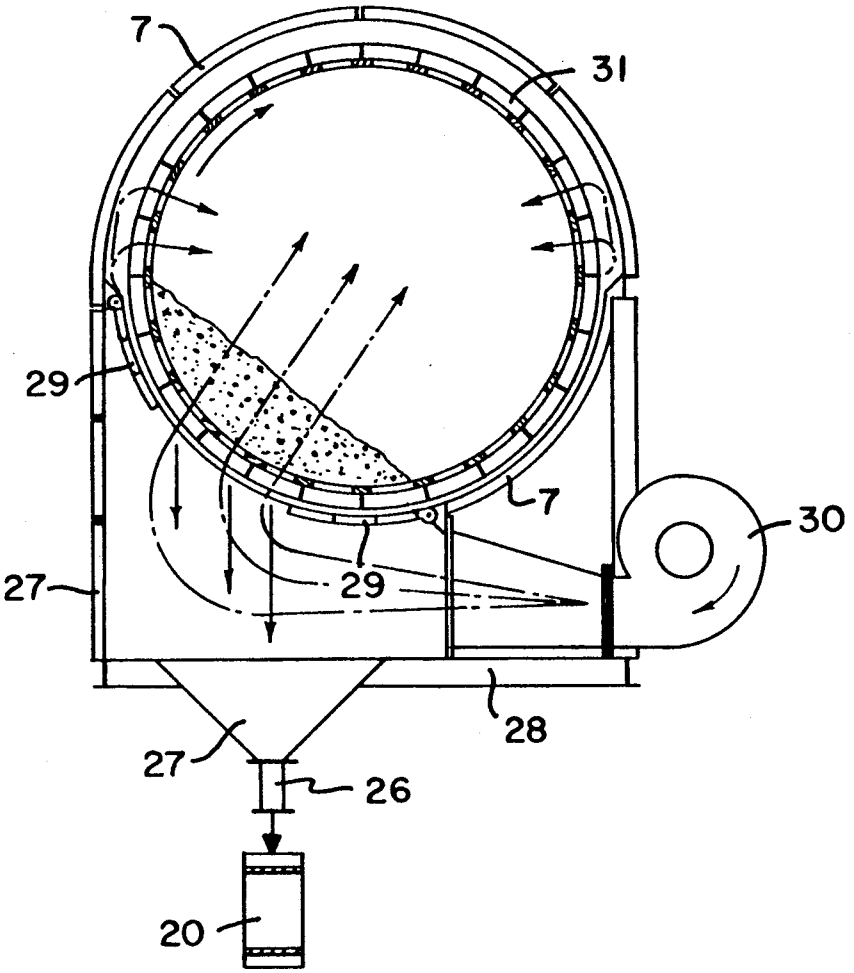

"HOUSING (7)"—Produced in carbon steel plate welded and screwed, comprises the static part of the cooler external structure, its function being to keep all the hot air confined inside the revolving grate, thus assuring a better thermal efficiency of the equipment (see FIGS. 1 and 3).

"BENT (curved) COOLING PLATES WITH SLOTS (8)"—Produced in refractory cast steel and fastened by means of screws to the inside surface of the revolving grate (3), its ultimate object is to keep the separation between the introduced hot clinker and the pressurized chambers, and at the same time conveys the cold air through the slots up to the mass of hot clinker, in constant turbulent movement, in order to cool it down (see FIGS. 1, 3, 6 and 7).

"BENT (curved) SMOOTH PLATES (9)"—Produced in refractory cast steel and fastened to the inside surface of the revolving grate (3) by means of screws, they serve to protect the revolving grate 3 from the heat and severe abrasion of the clinker (see FIGS. 1, 4, 6 and 7). As shown, bent smooth plates 9 and bent smooth plates with lifting devices 12 (discussed below) are disposed adjacent the last row of the bent cooling plates 8.

Figure 4:
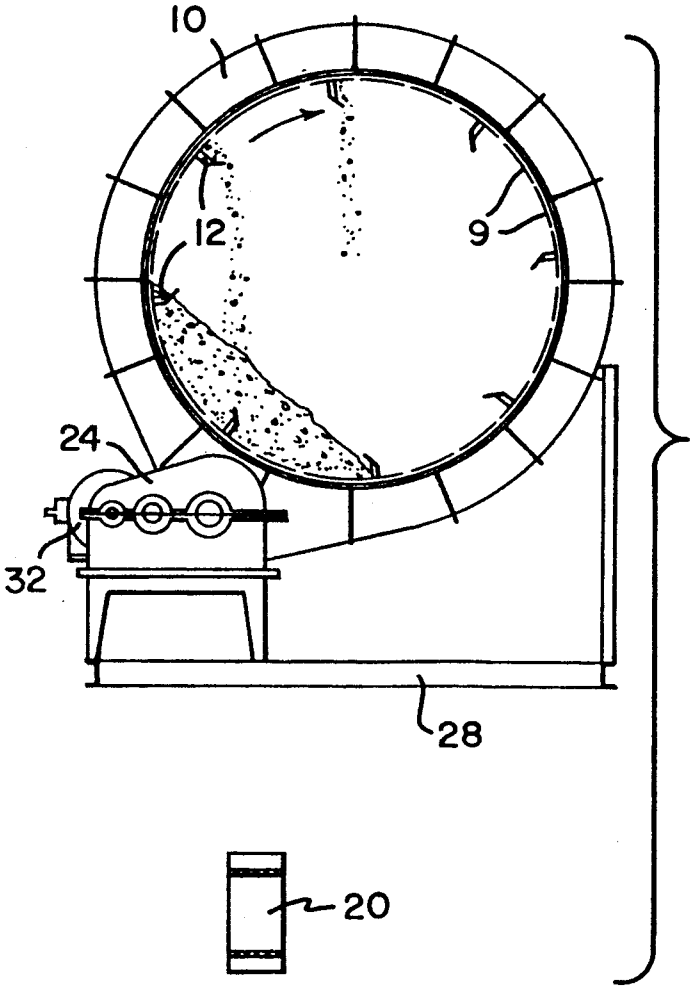

"CROWN JACKET (10)"—Produced in welded carbon steel plates, it serves to protect the crown (11) against entry of dust, avoiding as well the loss of lubricant from the pair in gear (see FIGS. 1 and 4).

"DRIVING CROWN (11)"—Produced in cast steel, fully machined and fastened to the revolving grate (3), by means of screws, pins and springs, it is responsible for the revolving movement of same (see FIG. 1).

"BENT (curved) SMOOTH PLATES WITH LIFTING DEVICES (12)"—Produced in refractory cast steel and fastened to the revolving grate (3), by means of screws, its ultimate object is to protect the revolving grate 3 from the heat and severe abrasion of the clinker, as well as to further the lifting of clinker larger particles and letting them fall freely and clash against the plates 9 and 12, in order to break them by impact, thus helping to obtain a better cooling of their core (see FIGS. 1, 4, 6 and 7).

"FINAL SEALING SYSTEM (13)"—Produced in carbon steel sheet and cast iron plates, it is fixed to the revolving grate (3) and to the dust removal duct (14) by means of screws, pins and welding and serves to avoid the entry of false air into the dust removal duct (14) (see FIG. 1).

Figure 5:
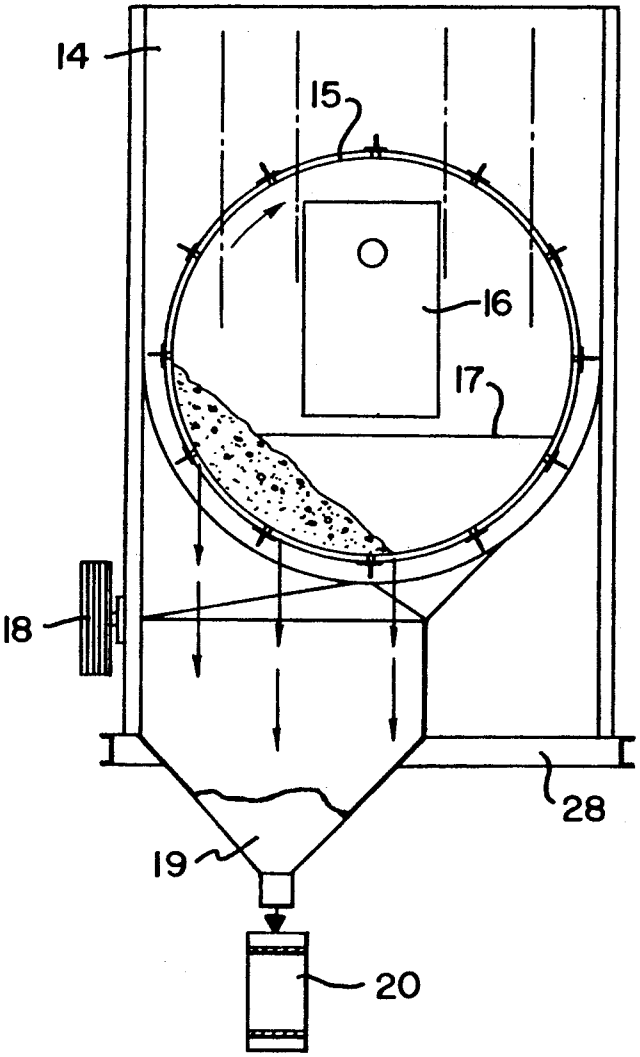

"DUST REMOVAL DUCT (14)"—Produced in welded carbon steel sheets, its ultimate object is to convey the excess of cooling air, contaminated with clinker dust, to a filtering system with the purpose to recover this usable fraction of the product (see FIGS. 1 and 5).

"BENT CLASSIFIER BARS (15)"—Produced in carbon steel and fastened by means of screws and welding to the final part of the revolving grate (3), its function is to separate the larger particles of clinker, inadequate for the transportation system and subsequent milling, conveying them to the crusher (18), which will reduce them to a convenient size (see FIGS. 1 and 5).

"UPPER INSPECTION DOOR (16)"—Produced in welded carbon steel and fastened to the rear part of the dust removal duct (14), it serves to permit inspections and maintenance works inside the revolving grate (3) (see FIGS. 1 and 5).

"FOOTBRIDGE (17)"—Produced in carbon steel angle bars and sheets, it serves to give access to the upper inspection door (16) (see FIGS. 1 and 5).

"CLINKER CRUSHER (18)"—This is an equipment also called hammer mill and it serves to reduce the size of clinker large particles into convenient dimensiones (see FIGS. 1 and 5).

"CLINKER RECEIVING HOPPER (19)"—Produced in welded carbon steel sheet, it serves to convey the selected cold clinker via classifier bars (15) as well as the crushed one, to the cell conveyor (20) under the cooler (see FIGS. 1 and 5).

"CELL CONVEYOR (20)"—This is continuous conveying equipment for loose cargos, which serves to convey the cold clinker up to the storage premises (see FIGS. 1, 2, 3, 4 and 5).

"SUPPORTING ROLLER BEARINGS (21)"—They are normally the sliding type with bronze or patent metal bushingss and their ultimate object is to bear the supporting rollers (22), by means of their axles (see FIGS. 1 and 2).

"SUPPORTING ROLLERS (22)"—Produced in cast and wrought steel, it serves to support the rolling rings, permitting their rotary movement, together along with the entire revolving grate unit (3) (see FIGS. 1 and 2).

"DRIVING PINION (23)"—Produced in cast and fully machined steel, its ultimate object is to transmit the rotary movement of the speed reducer (24) to the crown (11) (see FIG. 1).

Figure 6:
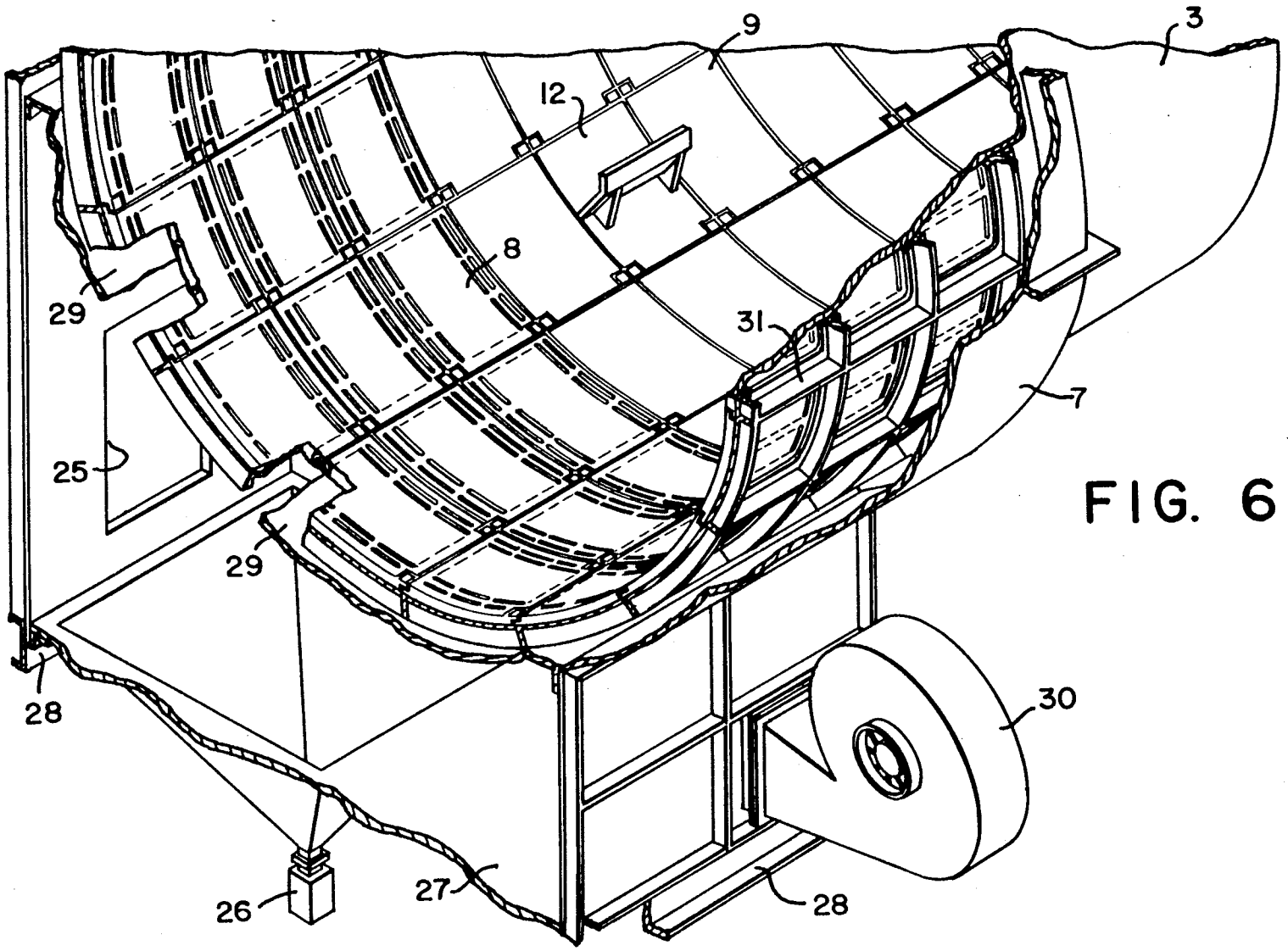
Figures 7, 8, 9:
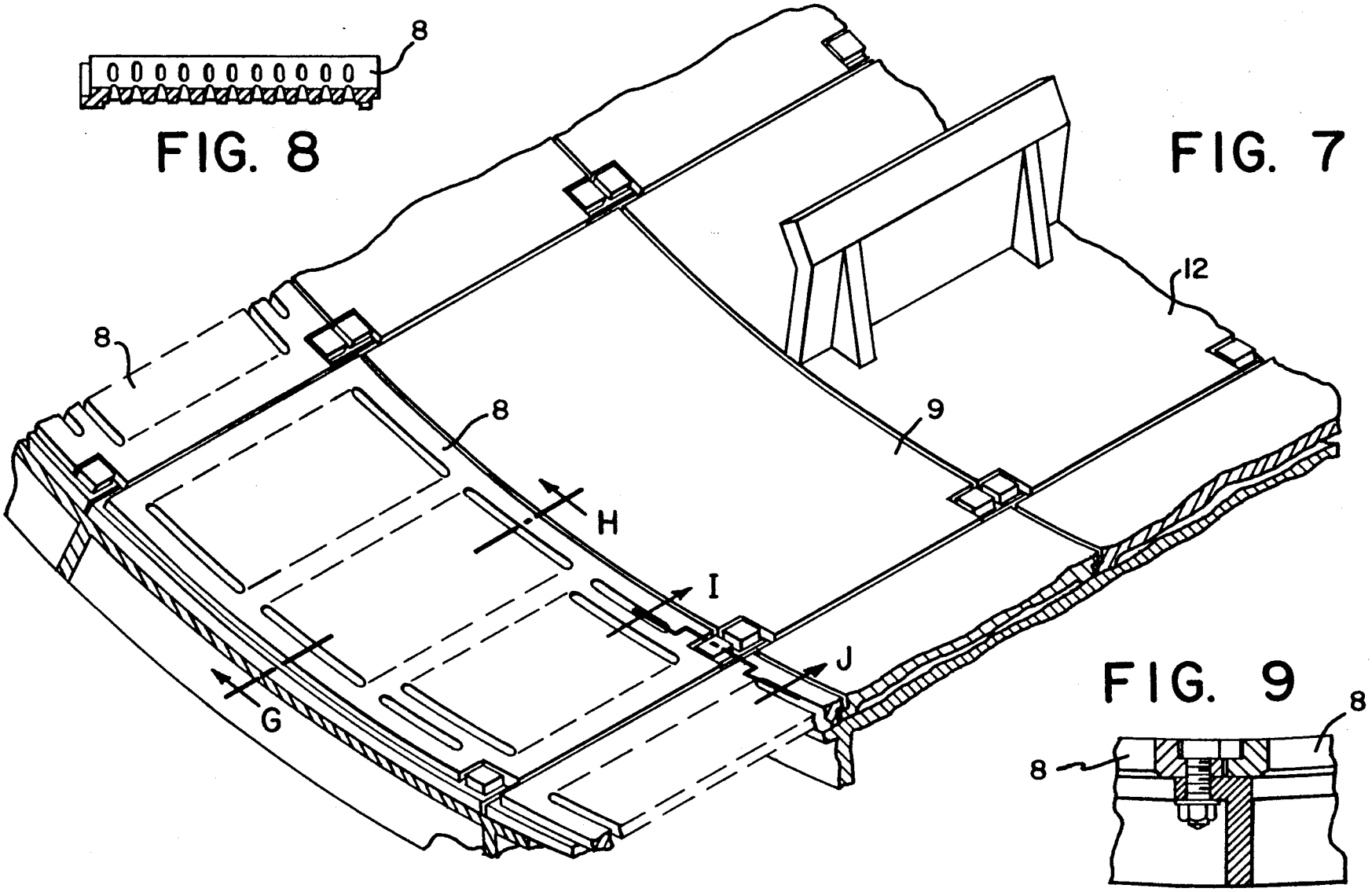
FIG. 7 is an enlarged view of the plates 8, 9 and 12.
FIG. 8 and 9 are cross-section view taken along lines G-H and I-J, respectfully, of FIG. 7 to make easier its interpretation.

"SPEED REDUCER (24)"—As its very name indicates, it is an equipment which serves exclusively to reduce the rotation of the driving engine up to the pinion (23) in order to permit an adequate final rotation of the revolving grate (3) (see FIGS. 1 and 4 and 6).

"LOWER INSPECTION DOORS (25)"—Produced in welded carbon steel sheet, it serves to permit the access to the inside of the pressurized chambers (27) for inspection and maintenance works (see FIG. 1).

"DOUBLE-PENDULAR VALVES (26)"—Equipments driven by electric motors or air pistons, to permit the output of cold fine clinker, gathered at the lower part of the pressurized chambers (27), however without permitting that false air enters from the outside (see FIGS. 1, a and 3 and 6).

"PRESSURIZED CHAMBERS (27)"—Produced in welded carbon steel sheet, their ultimate object is to keep all the air blown by fans (30) under a pre-establsihed constant pressure, forcing its passage through the slots of the cooling plates (8), bringing about the cooling down of the hot clinker, subject to the continuous movement of the air, permitting as well the collection of all cold clinker particles, which due to gravity pass through the same already referred to, slots and will deposit at the lower part of each pressurized chamber, where the double-pendular valves are in charge to feed the cell conveyor (20) (see FIGS. 1, 2, 3 and 6). As shown, the pressurized chamber 27 is located under the rotative grid 3 and is fixed to bearing structure 28.

"COOLER SUPPORTING STRUCTURE (28)"—Produced in welded and screwed carbon steel laminated sections, its ultimate object is to support all main components of the cooler which need to be fastened to the ground, such as: feeding duct (1), pressurized chambers (27), housing (7), pinion (23), crusher (18), etc. (see FIGS. 1, 2, 3, 4, 5 and 6).

"BENT SEALING AND COLD AIR FLOW GUIDING PLATES (29)"—Produced in welded carbon steel sheet and fastened by means of screws, pins and springs inside the pressurized chamber, they serve to guide the flow of cold air blown by fans (30) through slots of bent plates (8) directly to the center of the hot clinker mass, with the purpose b achieve its quick cooling and consequently obtaining a high thermal efficiency of the cooler (see FIG. 3 and 6). Note that the guiding plates 29 are fixed at one of their edges to pressurized chamber 27 below the revolving grate 3. Their free edges border the lower area of the grate 3 to allow the cold air flow (see arrows of FIG. 3) under pressure to pass therebetween into the grate 3 to cool the clinker.

"CENTRIFUGAL FANS (30)"—They are quite well known equipments and serve to blow air into the pressurized chambers for clinker cooling (see FIG. 3 and 6).

"REVOLVING GRATE REINFORCING STRUCTURE (31)"—Produced in longitudinal and circumferential carbon steel bars, welded to the external surface of the revolving grate (3), in an axial extension equivalent to the length of the pressurized chambers (27), they serve to reinforce the region of the revolving grate (3) which is weakened by through holes under the cooling plates (8) (see FIGS. 1 and 3).

"ELECTRIC MOTOR (32)"—Responsible for the driving of the revolving grate (3), should have a variably speed with speed control (see FIG. 1).

After having made known the functions of all parts which make up the herein dealt with cooler, we hereafter, present a description about the entire operation of same.

We, thus, start with the introduction of clinker or a similar product, recently manufactured, at very high temperature, in a continuous manner, into the feeding duct (1) (in practice, the discharge hood of the cooking oven rests directly on the duct mouth) which conveys it, due to gravity up to the inside surface of the cooler, over the 1st row of cooling plates (8). At this moment, the simultaneous action of three existing factors, which are: grate revolving, inclination of its symmetry axis and gravity, not only further the uniform distribution of the hot clinker in a bed form, over a longitudinal strip of the internal and lower surface of the grate (3), but also mantain it in continuous turbulent revolving movement, combined with slow axial displacement in direction to the final part of the cooler, where the classifier bars (15) are located.

During the entire longitudinal displacement over the cooling plates (8), currents of cold air, coming from pressurized chambers (27), continuously pass through the hot clinker bed, from down upwards, bringing about the clinker's quick cooling.

All clinker particles, smaller than the cooling plate slots (8) pass through same, due to the gravity action, whilst the hot clinker bed advances slowly in the horizontal direction, and fall vertically in countercurrent with the blown fold air, settling, totally cold in the lower part of the pressurized chambers, where doublependular valves are in charge to convey them to the cell conveyor (20).

Clinker particles which are larger than the cooling plate slots (8), and which cannot pass through same, advance in the longitudinal direction of the cooler, until they reach the classifier bars (15), placed at the end of the revolving grate (3). At this moment, as these particules are smaller than the openings formed by the classifier bars (15) themselves, they will then fall, due to gravity, also already cooled, into the receiving hopper (19) and, subsequently, into the cell conveyor (20).

Otherwise, if they are larger than the already mentioned openings, they will first fall into the clinker crusher (18), which will reduce their size, by impact, throwing them again inside the revolving grate (3) in order that they may try to follow the previously described cycle, until reaching the cell conveyor (20), which conveys them finally to the proper stock.

The cold air flow coming from the pressurized chambers withdraws most of the hot clinker bed heat when passing through same, from down up, cooling it down quickly, at the same time it continuously warms up and then reaches the grate inside, wherefrom a part will be sucked (the hotest part, corresponding to the air from the 1st and 2ns chambers) towards the baking oven which will use it as combustion secondary air, whilst the other part will be conveyed to the sand filter through the dust removal duct, as air excess containing clinker powder.

After this description of the operation of this cooler, subject cf this invention, we will hereafter mention some of the advantages to be had by its use:

a) Little space required for its implementation,
b) Operation quite simple, basically consisting in an adequate adjustment of the variable rotation of the revolving grate (3), in order to meet the requirements of all parameters of each wanted production level.
c) Non existence of movable cooling plates, thus eliminating excessive wear between them, prolonged stops and, consequentlym high mechanical maintenance costs.
d) Operation at low rotation, resulting in more durability.
e) Low driving power, therefore lower electric power consumption.
f) High thermal efficiency, reducing extraordinarily the fuel consumption in the baking oven, which uses the secondary air coming from the very heated cooler.
g) Sudden cooling of clinker, improving considerably its physical-chemical properties, as well as lowering greatly its temperature when coming out of the cooler.

I claim:

1. A revolving grate cooler for cooling of clinker or similar products, comprising a tubular shaped body having inner and outer surfaces and a plurality of holes formed therein, a plurality of metal cooling plates secured to said inner surface each having a plurality of openings cooperating with said plurality of holes, a pressurized chamber communicating with said body to provide air flow through said plurality of holes and openings for cooling the products within said body, and a plurality of curved guiding plates fastened to an internal upper portion of said pressurized chamber.

2. A revolving grate cooler as recited in claim 1, further comprising a fan communicating with said pressurized chamber for blowing air through said chamber.

3. A revolving grate cooler as recited in claim 2, wherein said pressurized chamber is disposed underneath said body.

4. A revolving grate cooler as recited in claim 3, wherein said pressurized chamber comprises a door which can be opened to allow access to an inside portion of said pressurized chamber.

5. A revolving grate as recited in claim 1, further comprising a mechanical seal secured to the front portion of said body and to a lower mouth of a feeding duct which communicates with said body.

6. A revolving grate cooler as recited in claim 1, further comprising a reinforcing structure having longitudinal and circumferential metal bars fastened to said outer surface of said body by welding to cover substantially the entire portion of said body which has said plurality of holes.

7. A revolving grate cooler as recited in claim 6, further comprising a plurality of bent guiding plates fastened to an internal upper portion of said pressurized chamber in a region near said reinforcing structure.

8. A revolving grate cooler for cooling of clinker or similar products, comprising a tubular chamber having first, second, and third sets of curved plates secured to an internal surface of said chamber along its length the clinker travelling along the length of said chamber and over said first, second and third sets of plates, said first set of plates secured to a front portion of said chamber where the clinker enters and having at least one opening formed therein for cooling air to flow therethrough to the chamber, said second set of plates secured to a middle portion of said chamber and having an uninterrupted, smooth surface, said third set of plates secured to a middle portion of said chamber and having a projection extending outwardly from its surface to break up the clinker.

9. A revolving grate cooler as recited in claim 8, further comprising a plurality of separation bars disposed at a rear portion of said chamber to allow passage of small particles of the products.

10. A revolving grate cooler as recited in claim 7, wherein each of said plates are composed of metal.

11. A revolving grate cooler as recited in claim 10, further comprising a pressurized chamber communicating with said chamber to provide air flow to said products through the openings of said first set of plates as said chamber rotates.

12. A revolving grate cooler for cooling of clinker or similar products, comprising a tubular shaped body having inner and outer surfaces and a plurality of holes formed therein, a plurality of curved metal cooling plates arranged in a series of rows secured to said inner surface each having a plurality of openings cooperating with said plurality of holes, a pressurized chamber communicating with said body to provide air flow through said plurality of holes and openings for cooling the products within said body, and a first plurality of curved solid metal plates secured to said inner surface of said body adjacent a last row of said curved cooling plates.

13. A revolving grate cooler as recited in claim 12, further comprising a second plurality of curved, solid plates secured to said inner surface of said body, each of said plates having a raised portion extending upwardly from its surface to protect the inner surface of said body and to assist in breaking the products within said body.

14. A revolving grate cooler as recited in claim 12, wherein at least said curved cooling plates are secured to said inner surface of said body by screws.

15. A revolving grate cooler as recited in claim 13, comprising a plurality of classifier bars disposed at an end portion of said body to separate the larger particles of the product.

16. A revolving grate cooler as recited in claim 12, comprising rolling rings supporting said body by bearing shoes.

17. A revolving grate cooler as recited in claim 12, wherein said body is slightly inclined form a horizontal plane.

* * * * *

UNITED STATES PATENT AND TRADEMARK OFFICE

CERTIFICATE OF CORRECTION

PATENT NO. : 5,018,968

DATED : May 28, 1991

INVENTOR(S) : JOSE DE ARRUDA BARRETO

It is certified that error appears in the above-identified patent and that said Letters Patent is hereby corrected as shown below:

On the title page item [76]
The name of the inventor should be changed from

"Jose D. Barreto" to --Jose de Arruda Barreto--.

Signed and Sealed this

First Day of December, 1992

*Attest:*

DOUGLAS B. COMER

*Attesting Officer*

*Acting Commissioner of Patents and Trademarks*